United States Patent [19]

Seitz

[11] 4,194,660

[45] Mar. 25, 1980

[54] SHEET FEED TRACTOR

[75] Inventor: Alan F. Seitz, Harwinton, Conn.

[73] Assignee: Data Motion, Inc., Torrington, Conn.

[21] Appl. No.: 957,683

[22] Filed: Nov. 6, 1978

[51] Int. Cl.[2] ..... B63H 17/38

[52] U.S. Cl. ..... 226/74

[58] Field of Search ..... 226/74, 75, 9, 59, 87; 271/2; 270/73; 74/231 C

[56] References Cited

U.S. PATENT DOCUMENTS

| | | | |
|---|---|---|---|
| 2,923,543 | 2/1960 | Metzner | 271/2.3 |
| 3,214,162 | 10/1965 | Breidenbach | 270/73 |
| 3,498,514 | 3/1970 | Howard | 226/9 |
| 3,606,122 | 9/1971 | Brewster | 226/74 |
| 3,938,721 | 2/1976 | Staneck | 226/75 |
| 4,130,230 | 12/1978 | Seitz | 226/75 |

*Primary Examiner*—Edward J. McCarthy

[57] ABSTRACT

A sheet-feed tractor is provided with raised land portions adjacent its drive and idler wheels. The raised land portions are positioned on the chassis of the tractor and shaped to form wall surfaces that are in radial registration with borders on a drive belt trained around the drive and idler wheels. The wall surfaces provide a positive means for preventing outward movement of the drive belt off the drive wheel and therefore prevent their disengagement.

7 Claims, 8 Drawing Figures

SHEET FEED TRACTOR

BACKGROUND OF THE INVENTION

The present invention relates to drive tractors for web material. It finds particular application in the type of sheet-feed tractor used to feed paper in high-speed printers.

Paper is often fed to high-speed printers by tractors that have toothed belts that engage holes provided along either border of the paper sheet. The toothed belts are often trained around two wheels, a drive wheel and an idler wheel. It is important that the belts move synchronously and in tandem so that both edges of the paper are moved at the same rate and at the same time. For this reason, the drive wheels for both of the belts are typically driven by the same drive means so that equal simultaneous movement of the drive wheels is almost certainly assured. In many cases, this also assures equal simultaneous movement of the drive belts.

The advancement of technology and the explosion of the data processing field have required increasingly fast printing of data on the paper sheets. As the speed of printing increases, so does the speed of advancement of the paper sheet, to the extent that the inertia of the paper sheet and the drive belt becomes significant. As a result, it is possible for the sudden jerking movements of the drive wheel to stretch the drive belt, possibly allowing it to deflect outward from its normal path of travel by an amount sufficient to allow the belt to disengage from the drive wheel. It is apparent that disengagement of one belt can at the very least cause the paper sheet to be bent or torn, and it could possibly result in jamming of the feeder.

In order to avoid disengagement of the belt from the drive wheel, tension on the drive belt can of course be increased by various means. However, the amount of tension required to avoid most instances of disengagement increases as the required speed of motion increases, and this of course increases wear on the various moving parts. In addition, mere increase in tension does not provide a positive means for preventing the undesired disengagement.

Accordingly, what is required is a positive means for preventing disengagement of the drive belt from the drive wheel that can be inexpensively provided and that does not significantly increase wear on the moving parts.

SUMMARY OF THE INVENTION

According to the present invention, a drive tractor for web material includes a chassis and a flexible endless belt mounted on the chassis. The belt has an inner driven surface and an outer driving surface and defines a closed path of travel. A belt driving means is mounted on the chassis and includes a rotatable member adapted to be rotated by a drive member, the rotatable member drivingly engaging the inner driven surface of the belt when the belt is in the path of travel. The chassis has wall means on it adjacent the rotatable member and extending transversely of the belt. The wall means is disposed outwardly of and closely adjacent the path of travel to limit the amount of deflection of the belt from the path and thereby prevent disengagement of the belt from the rotatable member.

In the preferred embodiment, the belt has pin members extending outwardly from it. The pin members are spaced from the edges of the belt to leave borders on both edges of the belt that are uninterrupted by the pins. The wall means has at least two wall surfaces, at least one associated with each border, and each wall surface is spaced transversely from the pin members but positioned directly outward from and in radial registration with one of the borders. Limiting by the wall means of deflection of the belt is thereby possible without interference with the pin members.

The chassis in one arrangement includes a chassis frame that has a planar web portion. The rotatable member includes a drive wheel rotatably mounted on the generally planar web portion of the chassis. The chassis further includes a chassis plate fastened to the chassis and positioned on the side of the wheel and the belt opposite the generally planar web portion of the chassis. The wall-forming means includes raised land portions on the chassis plate and on the generally planar web portion of the chassis, the raised land portions being positioned and shaped to form the wall surfaces in radial registration with the borders of the belt.

An idler wheel may also be rotatably mounted on the generally planar web portion of the chassis frame between the chassis frame and the chassis plate. It would be spaced from the drive wheel and engage the inner driven surface of the belt, and the belt would be trained around the drive wheel and the idler wheel. Preferably, the chassis plate and the web portion of the chassis frame are spaced to prevent transverse movement of the belt off the drive wheel and the idler wheel.

In an embodiment in which a second rotatable member is rotatably mounted on the chassis, the second rotatable member engages the inner driven surface of the belt when the belt is in the path of travel, the second rotatable member is spaced from the first rotatable member, and the belt is trained around the first and second rotatable members. Second wall means are provided on the chassis adjacent the second rotatable member, extending transversely of the belt, and disposed outwardly of and closely adjacent to the path to limit the amount of deflection of the belt from the path and thereby prevent disengagement of the belt from the second rotatable member. Again, each wall surface would be spaced transversely from the pin members but positioned directly outward from and in radial registration with the borders of the belt.

BRIEF DESCRIPTION OF THE DRAWINGS

These and further features and advantages of the present invention are described in connection with the attached drawings, in which.

DETAILED DESCRIPTION OF THE PREFERRED EMBODIMENT

Figures 1, 1A:
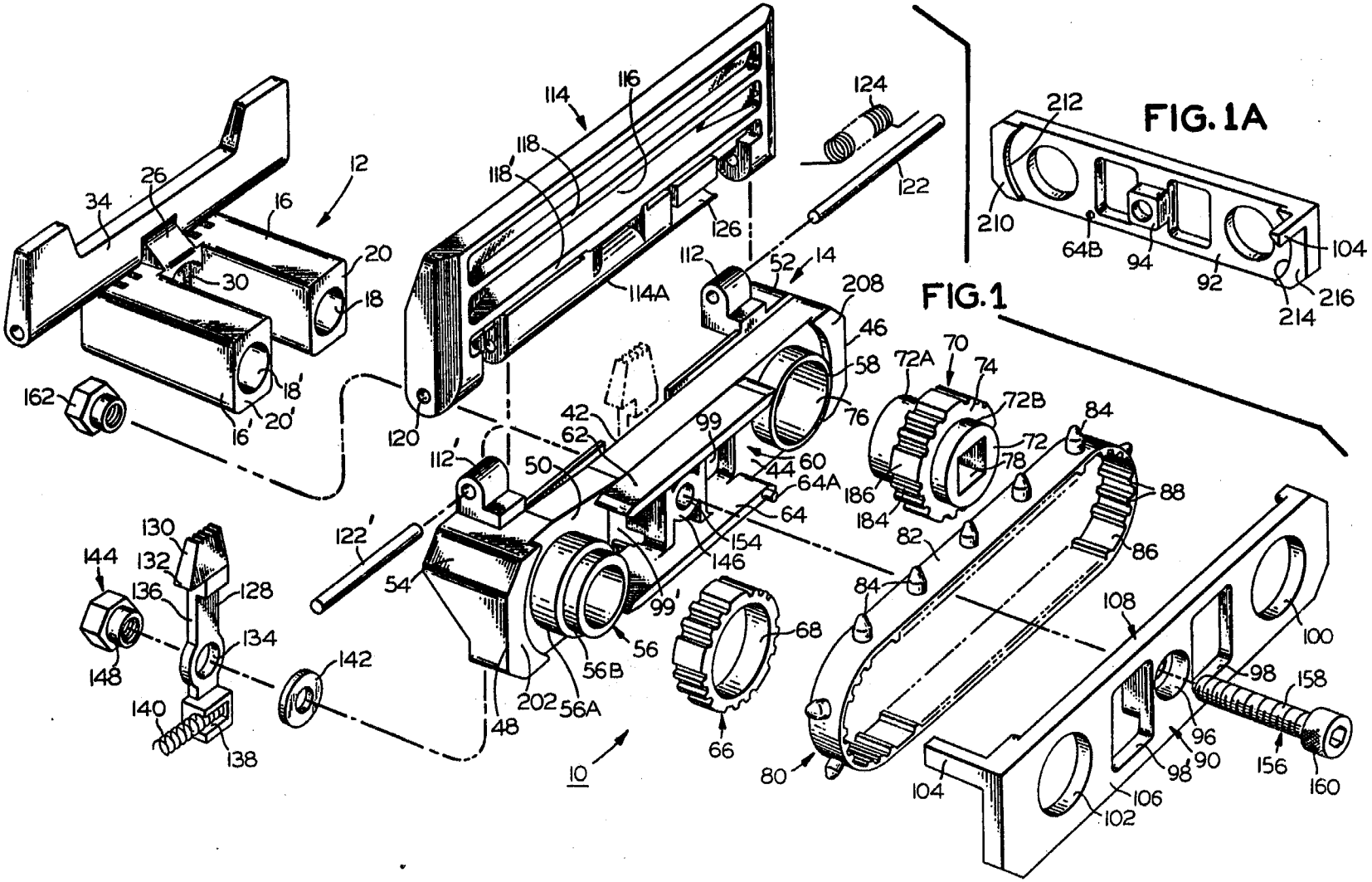
FIG. 1 is an exploded perspective view of the sheet-feed tractor of the preferred embodiment.
FIG. 1A is a perspective view of the side of the chassis plate 90 not shown in FIG. 1.

FIG. 1 shows, in exploded view, a drive tractor, generally indicated at 10 including a base member 12 and a chassis 14. Base member 12 has a generally U-shaped configuration. The various components are assembled as indicated by the dot-dash lines in FIG. 1. Base member 12 is comprised of guide means comprising a pair of parallel spaced apart shaft elements 16, 16' each of which is generally rectangular in cross section but having somewhat rounded corners. Each shaft element 16, 16' has a central bore 18, 18' formed therein and extending longitudinally of shaft elements 16, 16' and passing completely therethrough from front faces 20, 20', which comprise the forward end of base member 12, to rear faces, not visible in the drawings, which comprise the trailing end of base member 12. Shaft elements 16, 16' are joined at the trailing end of base member 12 by a connecting web portion that terminates at its upper end in a hinge block 26 of generally triangular shape. The connecting web portion has an arch-shaped opening formed therein which is undercut to provide an inverted U-shaped lip 30 therearound to seat a rotatable threaded member 162.

Hinge block 26 has a bore formed therein extending in a direction perpendicular to the longitudinal axes of shaft elements 16, 16' to receive therein a lock hinge pin. An elongated locking tab 34 is of generally planar construction having a central cutout portion (unnumbered) sized to fit over hinge block 26 and having bores extending longitudinally adjacent the hinged portions thereof to receive opposite end segments of the lock hinge pin.

Chassis 14 is of elongated construction and includes a chassis plate 90 and a chassis frame 42, which has a first sidewall portion 44 of planar configuration extending from feed end 46 to discharge end 48 of tractor 10.

Chassis frame 42 is seen to be of generally beam-like construction having a web portion generally indicated at 50 from which a flange-like feed end shoulder 52 and a discharge end shoulder 54 project laterally to the upper left of FIG. 1. Planar first sidewall portion 44 is provided by the side of web portion 50 opposite that from which shoulders 52, 54 project. An idler wheel bearing 56 projects outwardly of first sidewall portion 44. Idler wheel bearing 56 is in the form of a hollow cylinder having a stepped outer surface so that the outer diameter of the cylinder is larger at the base 56A projecting from first sidewall portion 44 than it is at the top 56B. A drive sprocket bearing 58 in the form of a simple hollow cylinder is provided at the end of chassis frame 42 adjacent feed end shoulder 52. Extending longitudinally between idler wheel bearing 56 and drive sprocket wheel bearing 58 is a belt support means 60 comprising a belt drive support element 62 and a belt return guide element 64. Support elements 62 and 64 are spaced apart from each other sidewise of chassis frame 42, element 64 having an assembly pin 64A projecting laterally from its side edge.

A toothed idler wheel 66 has an inner bearing portion 68 adapted to fit over idler wheel bearing 56 to be rotatably mounted thereon.

A toothed drive sprocket wheel 70 has a central cylindrical portion on which is formed a ring 74 having the sprocket teeth formed therein. Cylindrical portion 72 projects beyond opposite sides of ring 74 and cylindrical outer surface 72A is sized to be rotatably received within inner bearing portion 76 of sprocket wheel bearing 58. A shaftway 78 of square cross section extends longitudinally through cylindrical portion 72 from one end thereof to the other. Thus, idler wheel 66 is adapted to be mounted for rotation on bearing 56 and sprocket wheel 70 is adapted to be mounted for rotation on bearing 58.

An endless belt 80 is made of a flexible material and is adapted to be trained over wheels 66 and 70 in a loop. Belt 80 has an outer driving surface 82 from which a plurality of web engaging means conprising pins 84 project. Pins 84 are spaced apart along the length of belt 80 and project perpendicularly outwardly of driving surface 82 thereof. Pins 84 are centered on the longitudinal center line of driving surface 82 and are spaced apart equally along the length thereof. They are transversely spaced from the edges of the belt to leave longitudinal borders unobstructed by the teeth. Inner driven surface 86 of belt 80 has a plurality of belt teeth spaced apart along the length thereof and extending transversely across surface 86. Inner driven surface 86 is adapted to mesh with the teeth of wheels 66 and 70 to drive belt 80.

In addition to chassis frame 42, the chassis 14 also includes a chassis plate 90. The chassis plate is of elongated generally planar construction and, as shown in FIG. 1A, has an inner side thereof comprising a planar second sidewall portion 92 in which is formed an aperture 64B which is adapted to lockingly engage assembly pin 64A so as to securely mount chassis plate 90 upon chassis frame 42. Still referring to FIG. 1A, a raised land portion 94 of generally square periphery is seen to be formed on second sidewall portion 92 and projects laterally outwardly thereof. Land portion 94 has a bore 96 (FIG. 1) of circular cross section extending therethrough and through chassis plate 90. Spaced longitudinally apart on either side of land portion 94 are a pair of passage openings 98, 98' (FIG. 1) of generally rectangular cross section but having rounded or fillet corners. Passage openings 98, 98' are dimensioned and configured to receive therein for easy sliding passage therethrough shaft elements 16, 16'. Longitudinally spaced apart on opposite sides of openings 98, 98' are sprocket wheel opening 100 and idler bearing opening plate 102. Wheel opening 100 is circular in shape and is adapted to receive rotatably therein outer surface 72B of center cylindrical portion 72 of sprocket wheel 70. Similarly, idler bearing opening 102 is circular in shape and is adapted to rotatably receive therein outer surface 56B, the reduced diameter portion of idler wheel bearing 56. The cylindrical outer surface 56A of the large diameter portion of bearing 56 is adapted to receive idler wheel 66 rotatably thereon as indicated above.

Further raised land areas 210 and 216 are formed on the ends of the second sidewall 92. These land areas 210 and 216 are wall-forming members that form arcuate wall surfaces 212 and 214. Wall-forming members 210 and 216 are positioned opposite corresponding wall-forming members 208 and 202, respectively, which are raised land areas on the web portion 50 of the chassis frame 42. When assembled, corresponding wall-forming members are laterally spaced enough to permit teeth 84 to pass between them, but they are close enough to register radially with the border regions of the belt.

Chassis plate 90 has a parting arm 104 (FIG. 1) formed at its end thereof which is adapted to be positioned adjacent to discharge end shoulder 54 of chassis frame 42. Parting arm 104, as best seen in FIG. 1A, is triangular in cross section and, when chassis plate 90 is mounted upon chassis frame 42, extends entirely across the gap provided between plate 90 and frame 42 as described more fully hereinbelow. Outside wall 106 of chassis 90 is disposed opposite to second sidewall portion 92.

A pair of hinges 112, 112' are formed atop chassis frame 42, on respectively, the top surfaces of shoulders 52, 54. Hinges 112, 112' are longitudinally spaced apart along the longitudinal or first dimension of chassis frame 42. Hinges 112, 112' each contain a bore (unnumbered) passing therethrough parallel to the longitudinal axis of chassis frame 42. A cover plate 114 is generally rectangular in shape and has a central, longitudinal slot 116.

Cover plate 114 has formed on the underside thereof longitudinally extending bearing surfaces 118, 118' extending along opposite edges of slot 116. A longitudinally extending bore 120 extends through cover plate 114 parallel to and adjacent hinge edge 114A and is aligned with the bores formed in hinges 112, 112' so that cover plate hinge pins 122, 122' may be inserted therein to mount cover plate 114 for hinged rotation about chassis frame 42. A torsion spring 124 encircles cover plate hinge pin 122 and is received within a torsion spring retaining compartment 126 formed in cover plate 114 to spring bias cover plate 114 towards its open position in which it is rotated 90° counterclockwise from the position shown in FIG. 1.

A cover latch 128 has a catch portion 130 having a lip 132 formed at the lower portion thereof. A central bearing retainer socket 134 of circular cross section is formed in body portion 136. At the lower end of cover latch 128 a compression spring retaining compartment 138 is formed to receive therein one end of a compression spring 140. A washer 142 and a bearing nut 144 are employed to mount cover latch 128 on chassis frame 42.

Fastening means are provided by the combination of a threaded shaft 156 and a nut 162. Shaft 156 has a threaded shank 158 and an enlarged head 160 which is adapted to be seated within counterbored passage opening 96.

To assemble a drive tractor from its component parts it is necessary only to slip idler wheel 66 and drive sprocket wheel 70 over their respective bearings 56, 58 and train belt 80 over wheels 66 and 70 with belt teeth 88 meshed with the teeth on wheels 66 and 70. Chassis plate 90 is then mounted upon chassis frame 42 by engagement of assembly pin 64A with its respective aperture 64B. Cover plate 114 mounted to chassis frame 42 by means of cover plate hinge pins 122, 122' which are passed, respectively, through bore 120 and the bores (unnumbered) in hinges 112,112'. Torsion spring 124 is emplaced and the opposite legs thereof seat, respectively, against cover plate 114 and hinge 112. Cover latch 128 is mounted on chassis frame 42 with compression spring 140 having one end received within its retaining compartment 138 and its opposite end abutted against a flange not seen in the drawings that projects from the unseen side of chassis frame 42. Compression spring 140 is thus compressed between the flange and retaining compartment 138, and a retaining pin not shown serves to provide a stop for pivoting movement of latch 128 about the cylindrical bearing portion 148 of nut 144.

Chassis frame 42 is provided with frame passage openings 99, 99' that are of substantially identical configuration as corresponding passage openings 98, 98' of chassis plate 90. With chassis plate 90 mounted to chassis frame 42 passages 98, 99 and 98', 99' are in axial alignment and together cooperate to provide a pair of passages. Shaft 156 is threaded through chassis frame 42 and plate 90.

Body portion 12 is mounted upon chassis 14 by passing shaft elements 16, 16', respectively, through the passages 99 and 99' and 98 and 98' for sliding movement therein. The outer surfaces of shaft elements 16, 16' are configured to closely but slideably pass within the passages and to be constrained for linear sliding movement therein.

Figure 5:
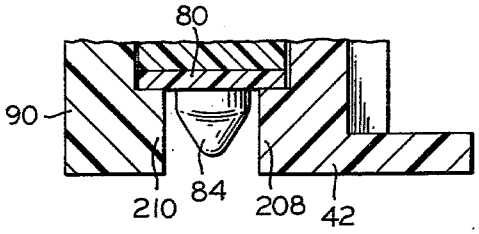
FIG. 5 is a cross-sectional view taken at lines 5—5 of FIG. 4.

Threaded shaft 156 is then passed through bore 96, bore 154 and extends between shaft elements 16 and 16', as may best be seen in FIG. 5 with respect to tractor 10 thereof. Nut 162, internally threaded to receive shaft 156, is seated upon lip 30, and the end of threaded shaft 156 opposite its head 160 is threadably engaged with nut 162.

As is indicated in Applicant's prior United States patent application Ser. No. 847,236, now U.S. Pat. No. 4,159,794 and more fully explained in it, the assembled tractor 10 is used in conjunction with a complementary tractor that is the mirror image of the one shown in FIG. 1 and is spaced from it so that holes on one side of suitably perforated paper can be engaged by teeth 84 on the tractor in FIG. 1, and corresponding teeth in the complementary tractor can engage holes on the other side of the perforated paper. The paper is advanced through the operation of the tractors.

Figure 2:
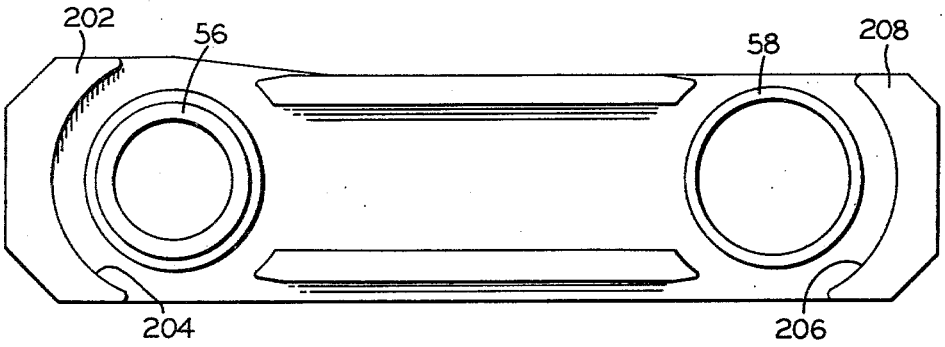
FIG. 2 is a simplified side elevation of the chassis frame shown in FIG. 1.
Figure 3:
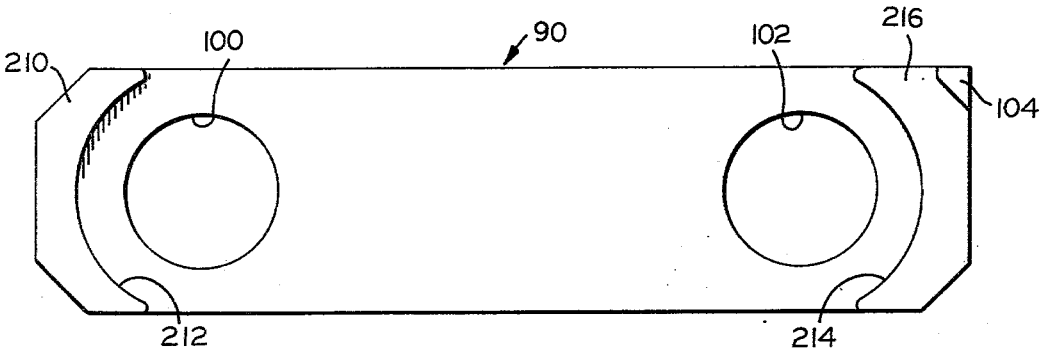
FIG. 3 is a simplified side elevation of the chassis plate from the side shown in FIG. 1A.

Attention is now invited to the wall means that include the land areas 202 and 208 on the chassis frame and 210 and 216 on the chassis plate. FIG. 2 is a side elevation, greatly simplified, of the chassis frame of FIG. 1. There it is seen that an arcuate wall surface 206 is formed by raised land area 208. This surface 206 matches a corresponding surface 212 (FIG. 3), which is provided by the land area 210 formed on the feed end of the chassis plate 90. Similar matching wall surfaces 204 and 214 are present at the discharge ends of the chassis frame and chassis plate, respectively.

Figure 4:
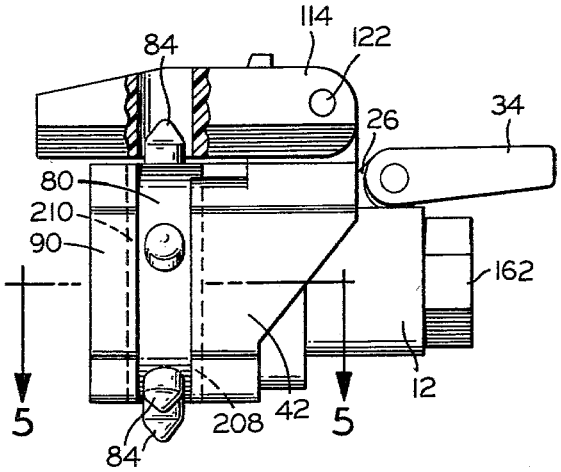
FIG. 4 is a side elevation showing the drive end of the assembled tractor shown exploded in FIG. 1.

As is best seen in FIGS. 4 and 5, the raised land areas 208 and 210 extend transversely of the belt and are disposed outwardly of but very closely adjacent to it. The wall surfaces are transversely spaced from the teeth 84, but they are positioned in radial registration with the borders left by the teeth 84 on either edge of the belt.

Figure 6:
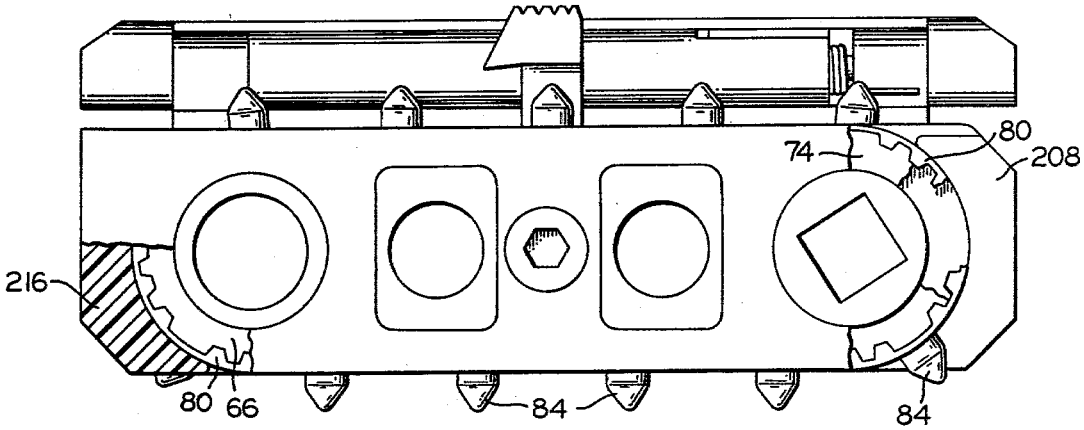
FIG. 6 is a simplified side elevation of the assembled tractor as seen from the right in FIG. 1 with parts of the chassis plate, the drive wheel, and the drive belt broken away.
Figure 7:
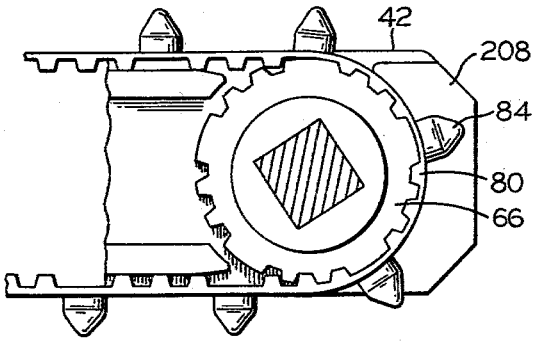
FIG. 7 is a simplified side elevation of the right-hand portion of the tractor as seen from the right in FIG. 1 with the chassis plate broken away to display the land area on the chassis frame and the drive wheel and drive belt.

FIGS. 6 and 7 are the best views for observing the outward spacing of the wall means. As FIGS. 6 and 7 show, the raised land area 208 is closely adjacent to the path of travel of the belt 80 so that it limits the amount of deflection of the belt from the path that it is intended to take. FIG. 6 also shows raised land area 216 providing the limiting function at the position of the other wheel 66.

In operation, appropriate drive means not shown apply torque to drive wheel 70, causing it to rotate, thereby driving belt 80. Teeth 84 on belt 80 engage holes provided for that purpose on the borders of the paper sheet to be fed. The paper accordingly moves along with drive belt 80. This feeding is effected through the tandem operation of both complementary tractors, so it is important that the tractor drive belts remain synchronized. However, it is conceivable in some prior-art arrangements for one of the belts to stretch, momentarily disengaging itself from the drive wheel. The resultant misalignment of the belts on the complementary tractors would cause the paper to be creased or torn.

With the arrangement shown in FIGS. 1 through 7, however, the drive belts always remain aligned as long as the drive wheels are in alignment. This is because the raised land areas 208 and 210 positively prevent the belt from being deflected outwardly from the intended path by enough to allow the belt 80 to come out of engagement with the drive wheel 66. Raised land areas 202 and 216 perform the same function with respect to the idler wheel 66. Accordingly, a sheet-feed tractor provided with the wall means described above provides significant advantages over prior-art tractors without significant increase in tractor cost.

Having thus described the invention, I claim:

1. In a drive tractor for web material, the combination comprising:

a. a chassis;

b. a flexible endless belt mounted on said chassis, said belt having an inner driven surface and an outer driving surface and defining a closed path of travel; and c. belt driving means mounted on said chassis and including a rotatable member adapted to be rotated by a drive member, said rotatable member drivingly engaging said inner driven surface of said belt when said belts is in said path of travel;

said chassis having wall means thereon adjacent said rotatable member and extending transversely of said belt and disposed outwardly of and closely adjacent said path of travel to limit the amount of deflection of said belt from said path and thereby prevent disengagement of said belt from said rotatable member.

2. The combination of claim 1 wherein said belt has pin members extending outwardly therefrom, said pin members being spaced from the edges of said belt to leave borders on both edges of said belt that are uninterrupted by said pins, and wherein said wall means has at least two wall surfaces, at least one associated with each border, each wall surface being spaced transversely from said pin members but being positioned directly outward from and in radial registration with one of said borders, limiting by said wall means of deflection of said belt thereby being possible without interference with said pin members.

3. The combination of claim 2 wherein said chassis includes a chassis frame that has a planar web portion, said rotatable member including a drive wheel rotatably mounted on said generally planar web portion of said chassis, and wherein said chassis further includes a chassis plate fastened to said chassis and positioned on the side of said wheel and said belt opposite said generally planar web portion of said chassis, said wall-forming means including raised land portions on said chassis plate and on said generally planar web portion of said chassis, said raised land portions being positioned and shaped to form said wall surfaces in radial registration with said borders of said belt.

4. The combination of claim 3, further including an idler wheel rotatably mounted on said generally planar web portion of said chassis frame between said chassis frame and said chassis plate, said idler wheel being spaced from said drive wheel and engaging said inner driven surface of said belt, said belt being trained around said drive wheel and said idler wheel.

5. The combination of claim 4 wherein said chassis plate and said web portion of said chassis are spaced to prevent transverse movement of said belt off said drive wheel and said idler wheel.

6. The combination of claim 1 further comprising;

a. a second rotatable member rotatably mounted on said chassis, said second rotatable member engaging said inner driven surface of said belt when said belt is in said path of travel, said second rotatable member being spaced from said first rotatable member, said belt being trained around said first and second rotatable members;

b. second wall means on said chassis adjacent said second rotatable member and extending transversely of said belt and disposed outwardly of and closely adjacent to said path to limit the amount of deflection of said belt from said path and thereby prevent disengagement of said belt from said second rotatable member.

7. The combination of claim 6 wherein said belt has pin members extending outwardly therefrom, said pin members being spaced from the edges of said belt to leave borders on both edges of said belt that are uninterrupted by said pins, and wherein each of said wall means has at least two wall surfaces, at least one associated with each border of said belt, each wall surface being spaced transversely from said pin members but positioned directly outward from and in radial registration with said borders of said belt, limitation by said wall means of deflection of said belt thereby being possible without interference with said pin members.

* * * * *